US008820397B2

(12) United States Patent
Marzouk et al.

(10) Patent No.: US 8,820,397 B2
(45) Date of Patent: Sep. 2, 2014

(54) THERMAL COMPONENT TEMPERATURE MANAGEMENT SYSTEM AND METHOD

(75) Inventors: Joe Marzouk, Conroe, TX (US); Michael Fripp, Carrollton, TX (US); Adan Hernandez Herrera, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 309 days.

(21) Appl. No.: 13/266,669

(22) PCT Filed: Apr. 27, 2010

(86) PCT No.: PCT/US2010/032537

§ 371 (c)(1),
(2), (4) Date: Nov. 17, 2011

(87) PCT Pub. No.: WO2010/129262

PCT Pub. Date: Nov. 11, 2010

(65) Prior Publication Data

US 2012/0048531 A1 Mar. 1, 2012

Related U.S. Application Data

(60) Provisional application No. 61/172,995, filed on Apr. 27, 2009.

(51) Int. Cl.
*E21B 36/00* (2006.01)

(52) U.S. Cl.
CPC ..... *E21B 36/00* (2013.01)
USPC ..... 166/57; 166/65.1; 166/302

(58) Field of Classification Search
CPC ..... E21B 36/001; E21B 47/01; E21B 47/011
USPC ..... 166/65.1, 302, 57
See application file for complete search history.

(56) References Cited

U.S. PATENT DOCUMENTS

| | | | | |
|---|---|---|---|---|
| 3,075,361 | A * | 1/1963 | Lindberg, Jr. | 62/4 |
| 3,125,159 | A * | 3/1964 | Lindgerg, Jr. | 165/86 |
| 4,282,931 | A * | 8/1981 | Golben | 169/61 |
| 4,402,915 | A * | 9/1983 | Nishizaki et al. | 422/202 |
| 4,510,759 | A * | 4/1985 | Sakai et al. | 62/46.2 |
| 5,184,470 | A | 2/1993 | Moser et al. | |
| 6,128,904 | A * | 10/2000 | Rosso et al. | 60/649 |
| 6,736,194 | B2 * | 5/2004 | Rockenfeller et al. | 165/104.12 |
| 7,213,409 | B1 | 5/2007 | Nuckols | |
| 7,258,169 | B2 * | 8/2007 | Fripp et al. | 166/302 |
| 7,717,167 | B2 * | 5/2010 | Storm et al. | 166/57 |
| 7,806,173 | B2 * | 10/2010 | Kaul et al. | 166/57 |
| 2002/0064692 | A1 * | 5/2002 | Johnson | 429/11 |
| 2002/0100288 | A1 | 8/2002 | Zuo | |
| 2003/0159829 | A1 * | 8/2003 | Fripp et al. | 166/373 |
| 2004/0016769 | A1 * | 1/2004 | Redmond | 222/3 |
| 2006/0102353 | A1 | 5/2006 | Storm et al. | |

OTHER PUBLICATIONS

PCT/US2010/032537 International Search Report and Written Opinion, Dec. 30, 2010 (9 p.).

* cited by examiner

*Primary Examiner* — Kenneth L Thompson
(74) *Attorney, Agent, or Firm* — Conley Rose, P.C.

(57) ABSTRACT

A downhole tool includes a thermally sensitive component. The temperature of the thermally sensitive component is at least partially controlled by a temperature management system thermally coupled to the thermally sensitive component.

10 Claims, 7 Drawing Sheets

THERMAL COMPONENT TEMPERATURE MANAGEMENT SYSTEM AND METHOD

CROSS-REFERENCE TO RELATED APPLICATIONS

This application is a 35 U.S.C. §371 national stage application of PCT/US2010/032537 filed Apr. 27, 2010, which claims the benefit of U.S. Provisional Patent Application No. 61/172,995 filed Apr. 27, 2009, both of which are incorporated herein by reference in their entireties for all purposes.

STATEMENT REGARDING FEDERALLY SPONSORED RESEARCH OR DEVELOPMENT

Not Applicable.

BACKGROUND

To drill a well, a drill bit bores thousands of feet into the crust of the earth. The drill bit typically extends downward from a drilling platform on a string of pipe, commonly referred to as a "drill string." The drill string may be jointed pipe or coiled tubing, through which drilling fluid is pumped to cool and lubricate the bit and lift the drill cuttings to the surface. At the lower, or distal, end of the drill string is a bottom hole assembly (BHA), which includes, among other components, the drill bit.

To obtain measurements and information from the downhole environment while drilling, the BHA includes electronic instrumentation. Various tools on the drill string, such as logging-while-drilling (LWD) tools and measurement-while-drilling (MWD) tools, incorporate the instrumentation. Such tools on the drill string contain various electronic components incorporated as part of the BHA that generally consist of computer chips, circuit boards, processors, data storage, power converters, and the like.

Downhole tools must be able to operate near the surface of the earth as well as many hundreds of meters below the surface. Environmental temperatures tend to increase with depth during the drilling of the well. As the depth increases, the tools are subjected to a severe operating environment. For example, downhole temperatures are generally high and may even exceed 200° C. In addition, pressures may exceed 138 MPa. There is also vibration and shock stress associated with operating in the downhole environment, particularly during drilling operations.

The electronic components in the downhole tools also internally generate heat. For example, a typical wireline tool may dissipate over 135 watts of power, and a typical downhole tool on a drill string may dissipate over 10 watts of power. While performing drilling operations, the tools on the drill string also typically remain in the downhole environment for periods of several weeks. In other downhole applications, drill string electronics may remain downhole for as short as several hours to as long as one year. For example, to obtain downhole measurements, tools are lowered into the well on a wireline or a cable. These tools are commonly referred to as "wireline tools." However, unlike in drilling applications, wireline tools generally remain in the downhole environment for less than twenty-four hours.

A problem with downhole tools is that when downhole temperatures exceed the temperature of the electronic components, the heat cannot dissipate into the environment. The heat may accumulate internally within the electronic components and this may result in a degradation of the operating characteristics of the component or may result in a failure.

Thus, two general heat sources must be accounted for in downhole tools, the heat incident from the surrounding downhole environment and the heat generated by the tool components, e.g., the tool's electronics components.

While the temperatures of the downhole environment may exceed 200° C., the electronic components are often rated to operate at no more than 125° C. Thus, exposure of the tool to elevated temperatures of the downhole environment and the heat dissipated by the components may result in the degradation of the thermal failure of those components. Generally, thermally induced failure has at least two modes. First, the thermal stress on the components degrades their useful lifetime. Second, at some temperature, the electronics may fail and the components may stop operating. Thermal failure may result in cost not only due to the replacement costs of the failed electronic components, but also because electronic component failure interrupts downhole activities. Trips into the borehole also use costly rig time.

There are at least two methods for managing the temperature of thermal components in a downhole tool. One method is a heat storing temperature management system. Heat storing temperature management involves removing heat from the thermal component and storing the heat in another element of the heat storing temperature management system, such as a heat sink. Another method is a heat exhausting temperature management system. Heat exhausting temperature management involves removing heat from the thermal component and transferring the heat to the environment outside the heat exhausting temperature management system. The heat may be transferred to the drill string or to the drilling fluid inside or outside the drill string.

BRIEF DESCRIPTION OF THE DRAWINGS

For a more detailed description of the embodiments, reference will now be made to the following accompanying drawings.

DETAILED DESCRIPTION OF THE DISCLOSED EMBODIMENTS

The present disclosure relates to a thermal component temperature management system and includes embodiments of different forms. The drawings and the description below disclose specific embodiments with the understanding that the embodiments are to be considered an exemplification of the principles of the invention, and are not intended to limit the invention to that illustrated and described. Further, it is to be fully recognized that the different teachings of the embodiments discussed below may be employed separately or in any suitable combination to produce desired results. The term "couple," "couples," or "thermally coupled" as used herein is intended to mean either an indirect or a direct connection. Thus, if a first device couples to a second device, that connection may be through a direct connection; e.g., by conduction through one or more devices, or through an indirect connection; e.g., by convection or radiation. The term "temperature management" as used herein is intended to mean the overall management of temperature, including maintaining, increasing, or decreasing temperature and is not meant to be limited to only decreasing temperature.

Figure 1:
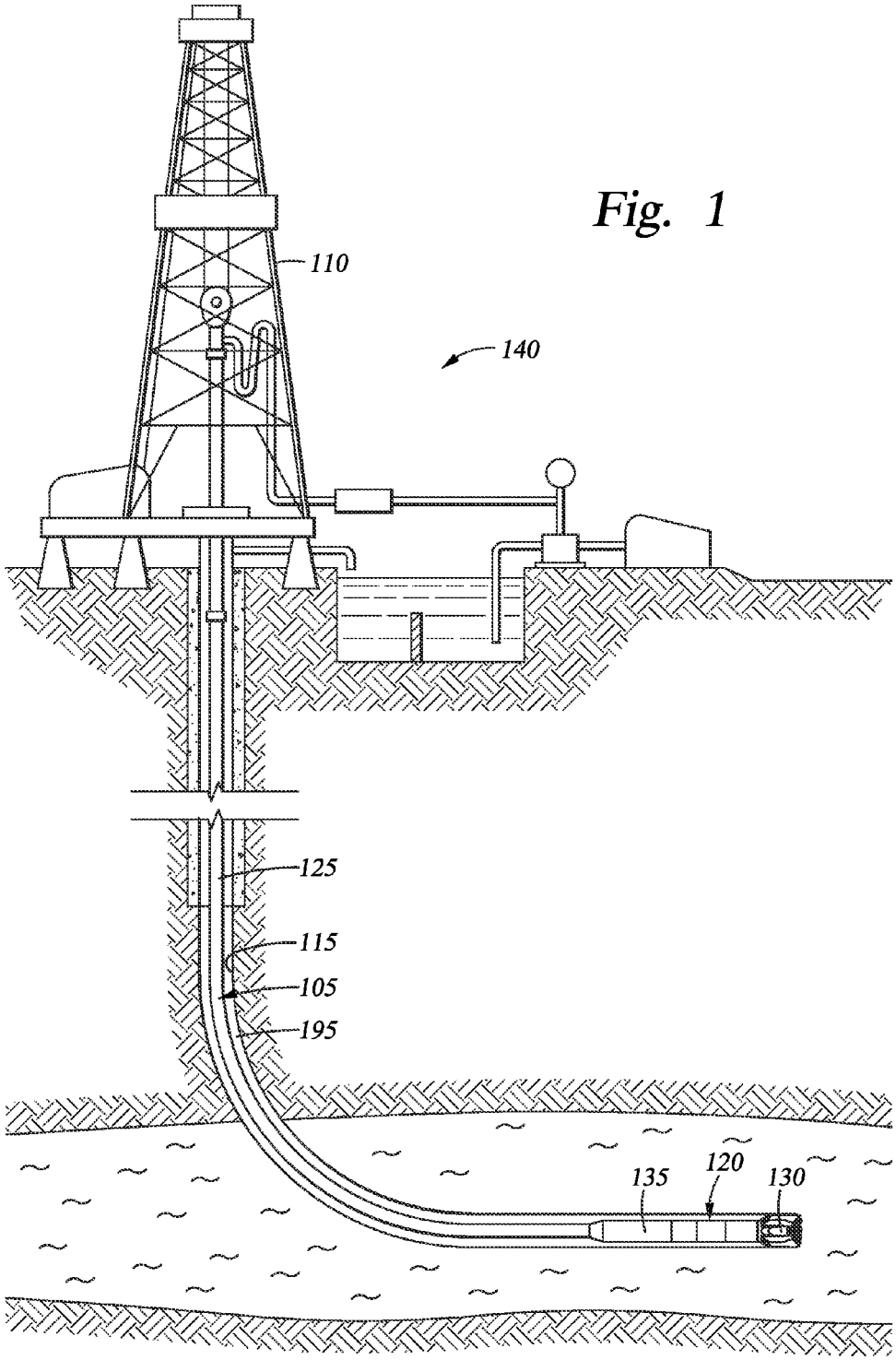
FIG. 1 is a schematic representation of a drilling system including a downhole tool with a temperature management system according to the principles disclosed herein.

Referring now to FIG. 1, a drilling system 140 including one or more downhole tools 135 having a temperature management system according to the principles disclosed herein is depicted. Drilling system 140 further includes a drill string 105 suspended from a rig 110 into a wellbore 115. Drill string 105 includes a drill pipe 125 that may be made up of a plurality of sections and to which a BHA 120 is coupled. BHA 120 includes a drill bit 130 and may include other components, such as but not limited to a drill sub, a motor, steering assembly, and drill collars. During drilling, drilling fluid, or "drilling mud," is circulated down through drill string 105 to lubricate and cool drill bit 130 as well as to provide a vehicle for removal of drill cuttings from wellbore 115. After exiting drill bit 130, the drilling fluid returns to the surface through an annulus 195 between drill string 105 and wellbore 115.

In this embodiment, rig 110 is land-based. In other embodiments, downhole tools 135 may be positioned within a drill string suspended from a rig on a floating platform. Furthermore, downhole tools 135 need not be disposed in a drill string, but may also be suspended by wireline, coiled tubing, or other similar device.

Figure 2B:
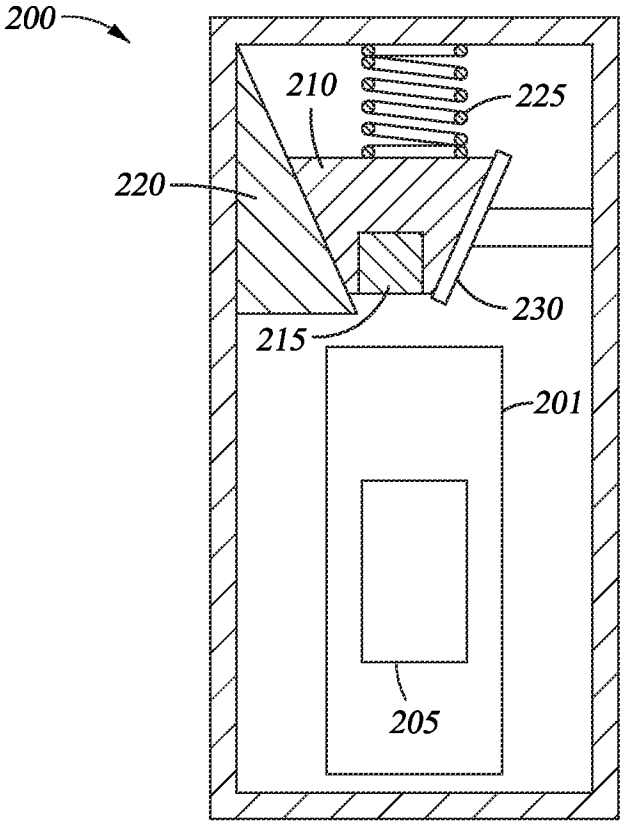
FIGS. 2A and 2B illustrate a temperature management system according to a first embodiment.
Figure 2A:
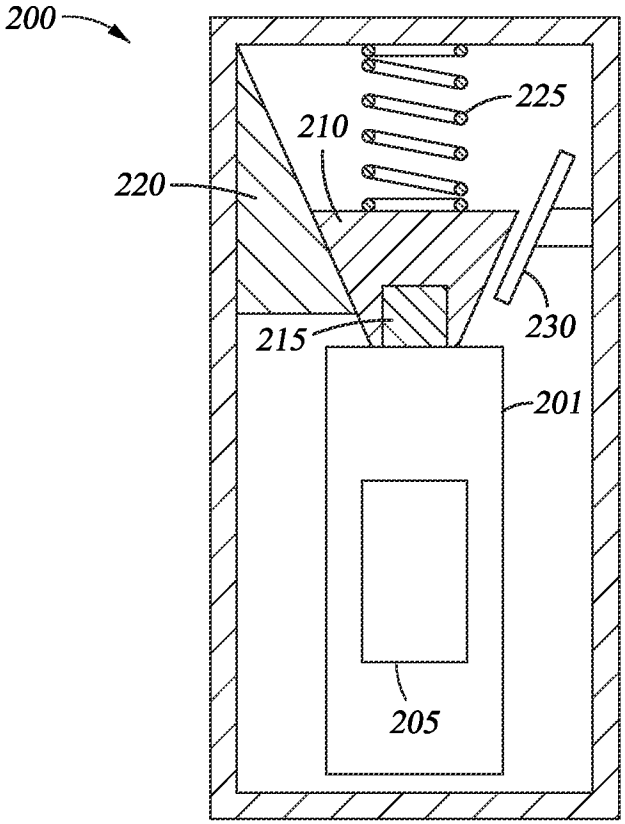

In FIGS. 2A and 2B, a temperature management system 200 for a downhole tool is illustrated according to one embodiment. Temperature sensitive components 205 are thermally coupled to a cold plate 201. Common temperature sensitive components 205 used in downhole tools, such as LWD tools, include sensors, computer processors, and other electrical components. The cold plate 201 may be formed of any thermally conductive material, such as aluminum. The temperature sensitive components 205 may be thermally coupled to the cold plate 201 through direct contact, or through thermally conductive intermediary components, such as, for example, thermal tape.

To remove heat from the cold plate 201, a metal hydride container 210 is selectively thermally coupled to the cold plate 201. The metal hydride inside the metal hydride container 210 may be packed as a powder surrounded by hydrogen, a gel with hydrogen infusing the gel, or in a binder with hydrogen permeating the binder. Metal hydrides reversibly store hydrogen in their metal lattice. Metal hydrides cool while releasing hydrogen and warm while absorbing hydrogen. Metal hydrides can be engineered to operate at different temperatures and pressures by modifying alloy composition and production techniques, which adjusts the equilibrium temperature and pressure. An example of a commercially available metal hydride is HY-STOR® alloy available from Ergenics, Inc. of Ringwood, N.J.

At a pressure or temperature lower than an equilibrium pressure or temperature, the metal hydride will absorb hydrogen as heat from the temperature sensitive components 205 and transfer heat to the cold plate 201, as shown in FIG. 2A. Each gram of hydrogen absorbed by the metal hydrides will release approximately 16,000 joules of heat. During a heat absorption phase, the metal hydride container 210 may be held against the cold plate 201 by a spring 225 or any other mechanical means. When a certain temperature is reached, or when operationally convenient, the metal hydride container 210 is thermally decoupled from the cold plate 201, as shown in FIG. 2B. The metal hydride container 210 may be pushed away from the cold plate by, for example, a piston 230. At least when thermally decoupled from the cold plate 201, the metal hydride container 210 is thermally coupled to a heat exhaustion component 220, which is able to exhaust heat away from the temperature management system 200. The exhaustion component 220 may be thermally coupled to the tool body of the downhole tool, which then dissipates heat into fluid flowing through the downhole tool or into fluid in the annulus of the wellbore.

While thermally coupled to the heat exhaustion component 220, the metal hydride will desorb hydrogen as it cools down, thus recharging the heat exhaustion component 220's ability to absorb heat. After cooling, the metal hydride container 210 may then be again thermally coupled to the cold plate 201 to repeat the heating and cooling cycle. Hydrogen may be absorbed and desorbed by the metal hydrides over a virtually unlimited number of cycles, which allows for the downhole tool to be used for extended time periods in the wellbore.

In one embodiment, the metal hydride container 210 includes a eutectic material 215 to reduce the severity of temperature swings during the heating and cooling cycle. Eutectic material is an alloy having a component composition designed to achieve a desired melting point for the material. The desired melting point takes advantage of latent heat of fusion to absorb energy. Latent heat is the energy absorbed by the material as it changes phase from solid into liquid. Thus, when the material changes its physical state, it absorbs energy without a change in the temperature of the material. Therefore, additional heat will only change the phase of the material, not its temperature. To take advantage of the latent heat of fusion, the eutectic material may have a melting point below the desired maintenance temperature of the temperature sensitive component 205.

Figure 3A:
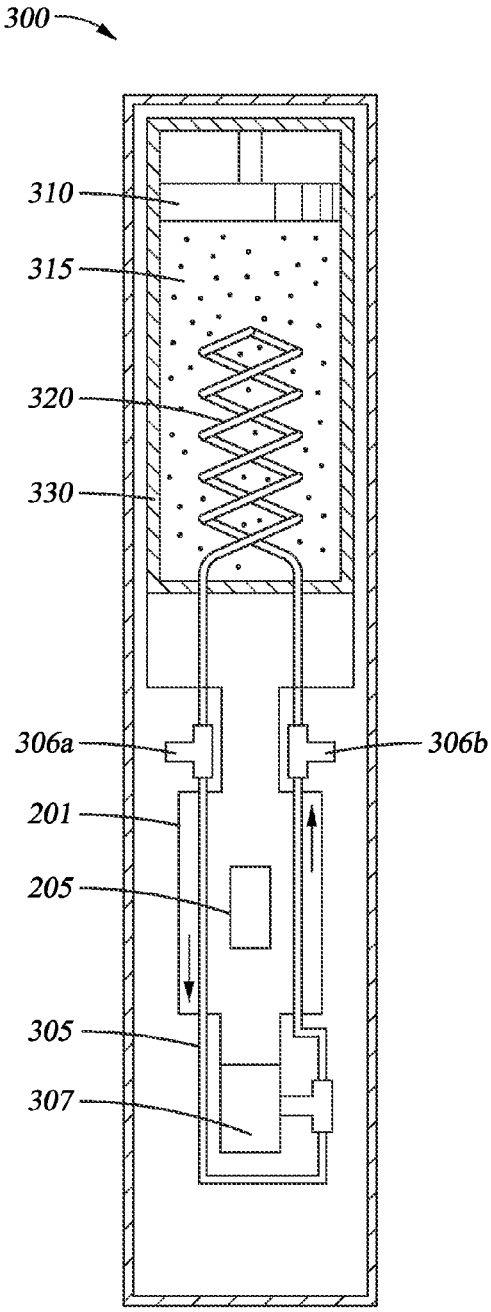
FIGS. 3A and 3B illustrate a temperature management system according to a second embodiment.
Figure 3B:
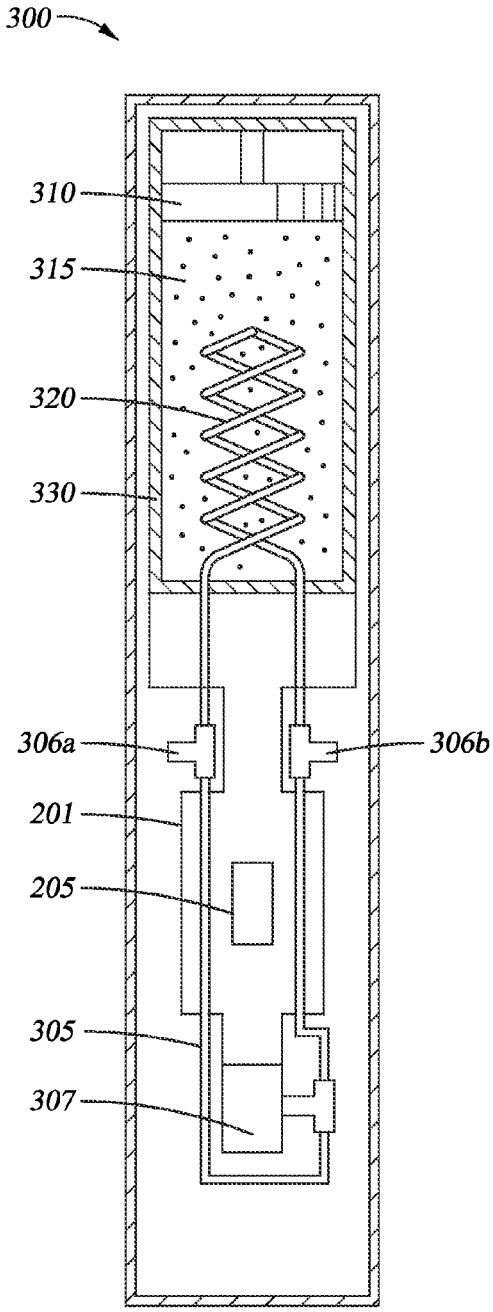

In FIGS. 3A and 3B, a temperature management system 300 is illustrated according to one embodiment. The temperature management system 300 shown in FIGS. 3A and 3B uses a pressure piston 310 to control the absorption of hydrogen by metal hydrides 315, which effectively controls the rate of heat absorption. The metal hydrides 315 are contained inside a sealed container 330 to allow for pressure control of the metal hydrides 315 by the pressure piston 310. The pressure piston 310 may be actuated, for example, using hydraulic pressure or electrical power. At a pressure lower than an equilibrium pressure, the metal hydrides 315 desorb hydrogen and absorb heat. The metal hydrides 315 are thermally coupled to the cold plate 201 by a circulation system that includes conduit 305 containing a working fluid, valves 306*a* and 306*b*, and a pump 307. When valves 306*a* and 306*b* are open and the pump 307 is active, the metal hydrides 315 are thermally coupled to the cold plate 201, as shown in FIG. 3A. When valves 306*a* and 306*b* are closed and the pump 307 is inactive, the metal hydrides 315 are thermally decoupled to the cold plate 201, as shown in FIG. 3B. The pump 307 may be, for example, a positive displacement pump, but may also be any other suitable pump.

Figure 5:
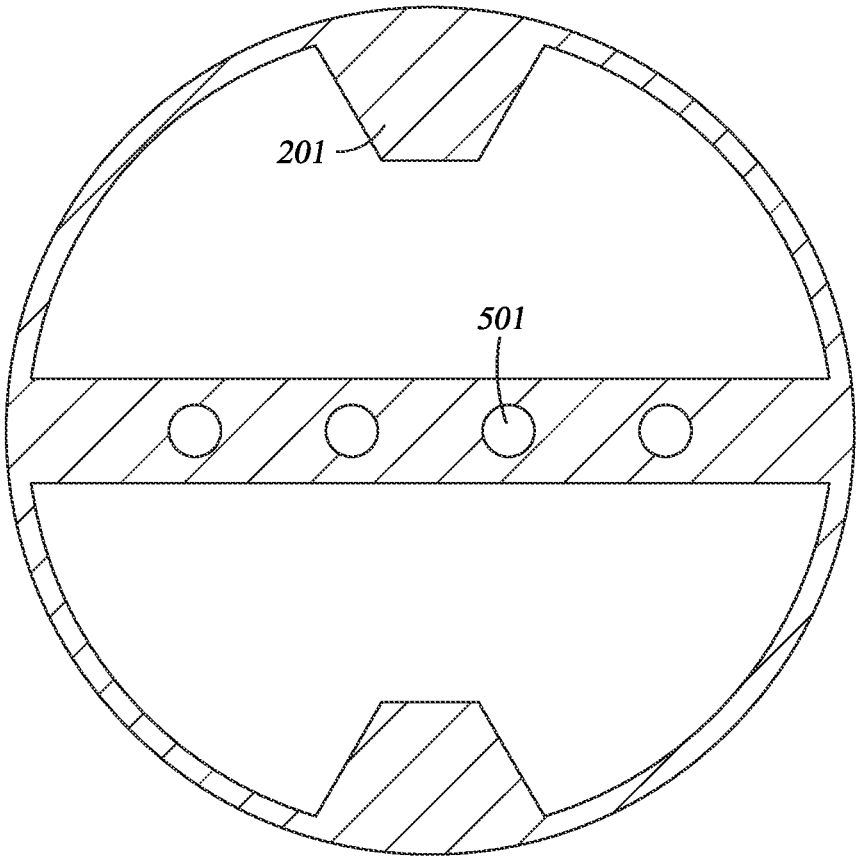
FIG. 5 illustrates a cold plate according to one or more embodiments.

To remove heat from the temperature sensitive components 205, pressure on the metal hydrides 315 is reduced and the pump 307 circulates the working fluid. The conduit 305 may run through channels or holes 501 formed in the cold plate 201, such as shown in FIG. 5. To more efficiently transfer heat to the metal hydrides 315, the conduit 305 may include a heat exchanger section 320, which may be, for example, a helical coil. The temperature of the metal hydrides 315 may be maintained constant by adjusting pressure on the metal hydrides 315 to help maintain a substantially constant cooling rate. As the hydrogen is completely exhausted from the metal hydrides 315, temperature will begin to increase in the metal hydrides 315 and a hydrogen recharge will be necessary to continue cooling.

During the recharge cycle, the valves 306*a* and 306*b* are closed and the pump 307 is inactive to thermally decouple the metal hydrides 315 from the cold plate 201. In the recharge cycle, the pressure piston 310 increases the pressure of the hydrogen inside the sealed container 330, which causes the metal hydrides 215 to reabsorb hydrogen and release heat. The heat may be exhausted to the wellbore through the tool body or any other thermal coupling. After exhausting heat, the circulation of the working fluid may be restarted and the pressure on the metal hydrides 315 reduced to start absorbing heat from the temperature sensitive components 205 again.

Figure 4A:
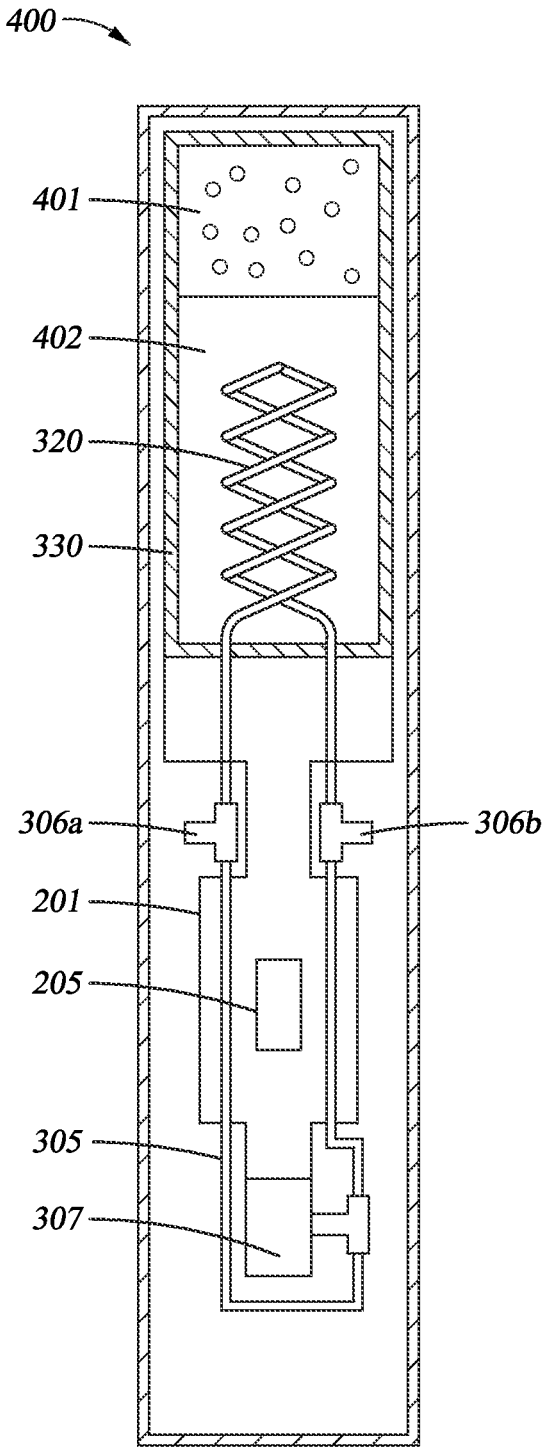
FIG. 4A illustrates a temperature management system according to a third embodiment.
Figure 4B:
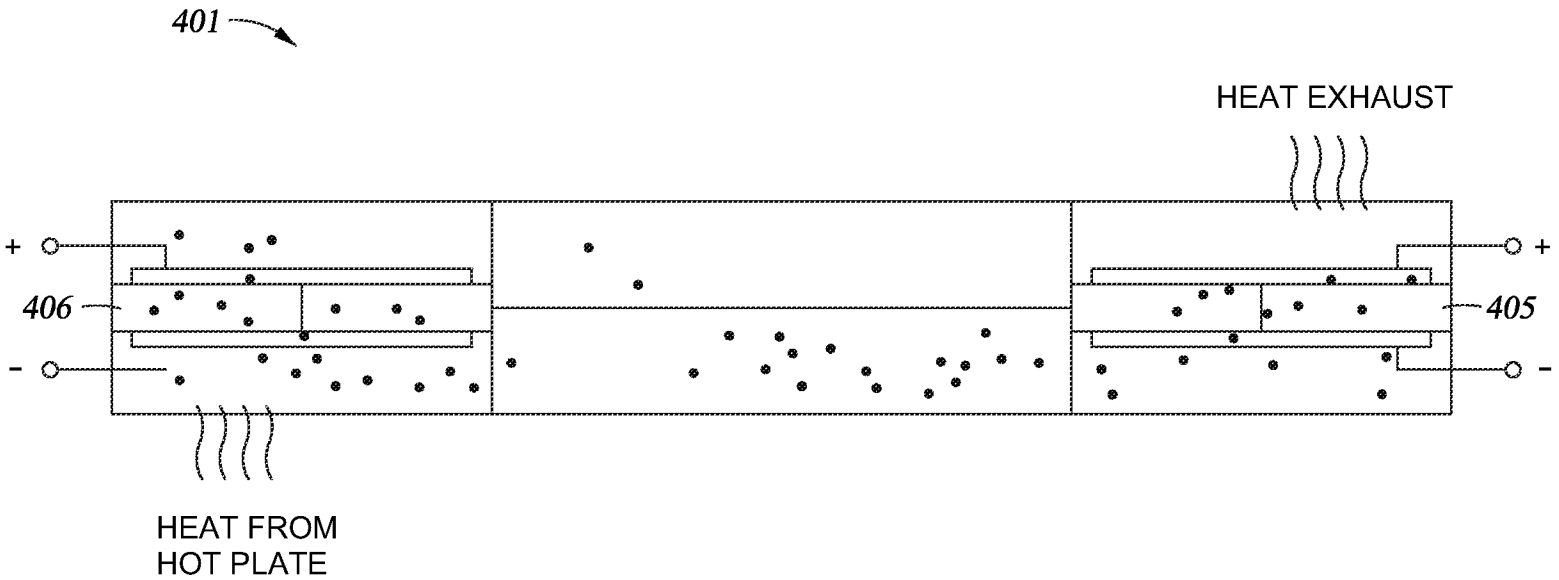
FIG. 4B illustrates a component of the temperature management system shown in FIG. 4A.

In FIG. 4A, a temperature management system 400 is illustrated according to one embodiment. The temperature management system 400 shown in FIG. 4A uses a thermoelectrical converter (TEC) system 401 to remove heat from the cold plate 201. The TEC system 401 is shown in greater detail in FIG. 4B. The TEC system 401 is a heat pump that uses ionizable gas, such as hydrogen, oxygen, or sodium, and electrical current to move heat from one end to the other. Two membrane electrode assemblies (MEA) 405 and 406 are provided at opposing ends of the TEC system 401. When an electrical charge is applied, the MEAs 405 and 406 pump the ionizable gas in a counterclockwise direction. The TEC system 401 shown in FIG. 4B is disclosed in U.S. Pat. No. 7,160,639 and commercially available from Johnson Electro-Mechanical Systems, Inc. of Atlanta, Ga.

The TEC system 401 is thermally coupled to a hot plate 402, which is thermally coupled to the cold plate 201 through a circulation system similar to the circulation system shown in FIGS. 3A and 3B. Valves 306*a* and 306*b* are optional because the TEC system 401 may be operated continuously if electrical power is continuously provided. In operation, heat from the temperature sensitive components 205 is transferred from the cold plate 201 to the working fluid in conduit 305. The working fluid transmits that heat to hot plate 402 through the heat exchanger 320. The TEC system 401 then exhausts the heat to the wellbore through the tool body or other intervening parts.

Figure 6:
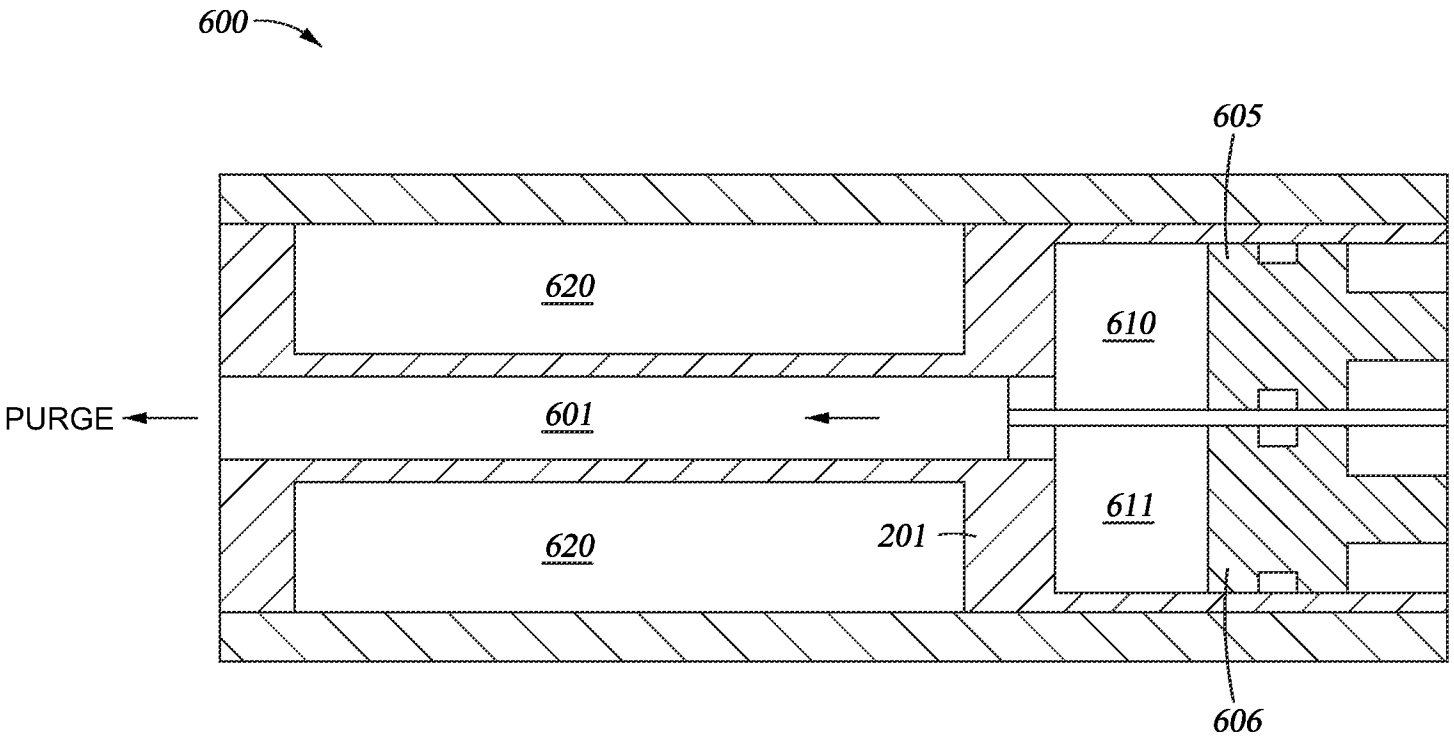
FIG. 6 illustrates a temperature management system according to a fourth embodiment.

In FIG. 6, a temperature management system 600 is illustrated according to one embodiment. The temperature management system 600 shown in FIG. 6 uses an endothermic reaction to remove heat from thermally sensitive components (not shown) contained in cooled areas 620. The endothermic reaction takes place within a cooling mixture chamber 601 within heat plate 201. Components of the cooling mixture are stored within component chambers 610, 611. A piston or auger 605, 606 controls the volume of each component of the cooling mixture forced into the cooling mixture chamber 601. For liquid components, a piston may be more suitable. For solid components, such as powder or crystals, an auger may be substituted. As the cooling mixture chamber 601 fills and the cooling mixture contained therein warms, the cooling mixture may be purged from the end opposite the component chambers 610, 611.

Various cooling mixtures may be used. In one embodiment, water is provided in component chamber 610 and combined with one or more of the following substances as the other component contained in component chamber 611: ammonium nitrate, sodium acetate, sodium nitrate, sodium thiosulfate, hydrous calcium chloride, sodium chloride, sodium bromide, magnesium chloride, and sulfuric acid. To optimize cooling efficiency, the relative portions of water and the other component may be controlled by the pistons or augers 605, 606 according to predetermined ratios. For example, 100 parts of ammonium nitrate may be combined with 94 parts of water. In another example, 36 parts of calcium chloride may be combined with 100 parts of water. It should be appreciated that the cooling mixtures disclosed herein are intended as examples of cooling mixtures that may be used in combination with the temperature management system 600.

Power for the downhole tool and the thermal management systems disclosed herein may be supplied by a turbine alternator, which is driven by the drilling fluid pumped through the drill string. The turbine alternator may be of the axial, radial, or mixed flow type. Alternatively, the alternator may be driven by a positive displacement motor driven by the drilling fluid, such as a Moineau-type motor. It is understood that other power supplies, such as batteries or power from the surface, may also be used. In one embodiment, electrical power is provided by the drill string from an electrical source on the surface.

The temperature management system removes enough heat to maintain the temperature sensitive component at or below its rated temperature, which may be; e.g., no more than 125° C. For example, the temperature management system may maintain the temperature sensitive components 205 at or below 135° C., or even at or below 80° C. Typically, the lower the temperature, the longer the life of the temperature sensitive components 205.

Thus, the temperature management system manages the temperature of the temperature sensitive components 205. Absorbing heat from the temperature sensitive components 205 thus extends the useful life of the temperature sensitive components 205 at a given environment temperature.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A downhole tool, comprising:

a body;

a temperature sensitive component housed within the body;

a cold plate thermally coupled to the temperature sensitive component; and a metal hydride selectively thermally coupled to the cold plate and thermally coupled to a body of the downhole tool;

wherein the metal hydride is formed as a powder and disposed within a metal hydride container containing hydrogen.

2. The downhole tool of claim 1, wherein the metal hydride container is not thermally coupled to the cold plate when thermally coupled to the body of the downhole tool.

3. The downhole tool of claim 2, further comprising a eutectic material disposed within the metal hydride container.

4. The downhole tool of claim 2, further comprising a piston to move the metal hydride container relative to the cold plate.

5. The downhole tool of claim 4, further comprising a spring biasing the metal hydride container towards the cold plate.

6. A downhole tool, comprising:

a body;

a temperature sensitive component housed within the body;

a cold plate thermally coupled to the temperature sensitive component; and a metal hydride selectively thermally coupled to the cold plate and thermally coupled to a body of the downhole tool;

wherein the metal hydride is disposed within a sealed container.

7. The downhole tool of claim 6, wherein the metal hydride is selectively thermocoupled to the cold plate by a circulation system comprising a conduit, a working fluid, and a pump.

8. The downhole tool of claim 7, wherein the circulation system further comprises at least two valves, and wherein closing the valves and deactivating the pump thermally decouples the metal hydride from the cold plate.

9. The downhole tool of claim 8, wherein the sealed container comprises a piston disposed therein, and wherein actuation of the piston varies the pressure on the metal hydride.

10. The downhole tool of claim 9, wherein the piston increases pressure on the metal hydride when the metal hydride is thermally decoupled from the cold plate and decreases pressure on the metal hydride when the metal hydride is thermally coupled to the cold plate.

* * * * *